US005178717A

United States Patent [19]

Rodriguez

[11] Patent Number: 5,178,717

[45] Date of Patent: Jan. 12, 1993

[54] ADHESIVE APPLICATOR

[76] Inventor: Peter A. Rodriguez, 1785 Selva Marina Dr., Atlantic Beach, Fla. 32233

[21] Appl. No.: 665,100

[22] Filed: Mar. 6, 1991

[51] Int. Cl.[5] ..... B32B 31/00

[52] U.S. Cl. ..... 156/523; 156/574; 156/577; 156/579; 156/584

[58] Field of Search ..... 156/523, 519, 521, 522, 156/574, 577, 579, 584; 242/56 R

[56] References Cited

U.S. PATENT DOCUMENTS

| | | | |
|---|---|---|---|
| 2,461,246 | 2/1949 | Weyenberg | 242/56 R |
| 3,406,084 | 10/1968 | Varga | 156/522 |
| 3,658,628 | 4/1972 | Zenter | 156/523 X |
| 3,969,181 | 7/1976 | Seabold | 156/577 |
| 4,004,962 | 1/1977 | Kleid | 156/479 X |
| 4,061,527 | 12/1977 | Traise | 156/519 |
| 4,582,558 | 4/1986 | Antonson | 156/523 |
| 4,659,029 | 4/1987 | Rodriguez | 242/56 R |
| 4,718,971 | 1/1988 | Summers | 156/579 X |
| 4,757,950 | 7/1988 | Rodriguez | 242/56 R |
| 4,783,018 | 11/1988 | Rodriguez | 242/56 R |
| 4,826,562 | 5/1989 | Ehlis | 156/523 |
| 5,046,657 | 9/1991 | Rodriguez | 242/56 R |

*Primary Examiner*—David A. Simmons
*Assistant Examiner*—J. Sells
*Attorney, Agent, or Firm*—Arthur G. Yeager

[57] ABSTRACT

A device for applying a strip of double-sided adhesive to a surface, the device including a roll of release tape to which the double-sided adhesive strip is attached, a transfer roller to remove the adhesive strip from the release tape and apply the strip to the surface, and a roller to wind up the release tape.

20 Claims, 2 Drawing Sheets

ADHESIVE APPLICATOR

BACKGROUND OF THE INVENTION

It is general practice in the paper industry to produce a continuous sheet or web of paper which is wound onto large spools. In order to have a continuous operation it is, of course, necessary to have a system for instantaneously switching from winding the web of paper onto a full roll to an empty roll, particularly at modern speeds of paper production. In U.S. Pat. No. 2,461,246 there is shown a method of feeding a tape onto the rotating empty roll core and causing it to be spirally wrapped on that core as it stretches tight across the traveling web of paper and cuts the paper, with the cut edge being led onto the empty roll supported by the cutting tape. Subsequent improvements such as shown in my three U.S. Pat. Nos. 4,659,029; 4,757,950; and 4,783,018 illustrate how a cutting tape can be passed through a guideway underneath a traveling web of paper, perhaps 10 to 20 feet or more wide and be attached to the far side of an empty spool while the operator remains on the near side of the spool. These patents teach the use of mechanical arms to receive a cut end of the tape with adhesive on the tape, and to push the cut end into contact with the empty spool which winds the tape helically around the spool, cutting the paper web as it does, and wrapping the on-coming web around the empty spool. Processing difficulties have arisen to indicate the need for handling errors, such as the failure to apply a suitable amount of adhesive to the tape, which, in turn, means that the tape does not attach itself properly to the empty spool and, therefore, does not cut the traveling web of paper and transfer it to the empty spool. In the modern high speed plants it is very important that any such errors be handled quickly and efficiently. One improvement has been to use double-sided pressure-sensitive adhesive tape as the adhesive strip on the cutting tape. This is disclosed generally in my U.S. Pat. No. 4,783,018 and in my copending patent application Ser. No. 07/494,418 filed Mar. 16, 1990. The present invention provides an improved apparatus for performing this task with double-sided pressure-sensitive adhesive tape. A second application of the present invention is to provide a hand held device to apply a strip of double-sided pressure sensitive adhesive tape to a cutting tape where, for any reason the feeding machinery failed to apply the necessary strip of adhesive to the leading portion of the tape.

It is an object of this invention to provide an improved apparatus for applying a short strip of double-sided pressure-sensitive adhesive tape to the forward portion of a length of cutting tape for use in transferring a traveling web of paper from one windup roll to another. It is another object of this invention to provide a hand held device for applying a strip of double-sided pressure sensitive adhesive tape to a cutting tape, or to any other surface. Still other objects will become apparent from the more detailed description which follows.

BRIEF SUMMARY OF THE INVENTION

This invention relates to a device for applying a strip of double-sided pressure-sensitive adhesive tape to a surface, such device comprising a supporting frame, a rotatable supply roll of composite tape consisting of a layer of double-sided adhesive tape adhered to a strippable backing tape; a rotatable rubbery pressure roller positioned to receive the composite tape from the supply roll and press the side with the double-sided adhesive tape against a rotatable transfer roller that has a poor affinity for the adhesive tape, a rotatable windup roller to receive the backing tape; a means for coordinating the rotation of the supply roll with the rotation of the windup roller; and a stop means for selectively permitting or preventing the rotation of the supply roll.

In a specific embodiment of this invention the device is a part of an integrated machine for handling the cutting tape from a supply roll to its use in cutting and transferring a traveling web of paper. In another embodiment the device of this invention is a hand held apparatus for applying a strip of adhesive to a surface.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features of this invention are best illustrated and understood by reference to the attached drawings.

Figure 1:
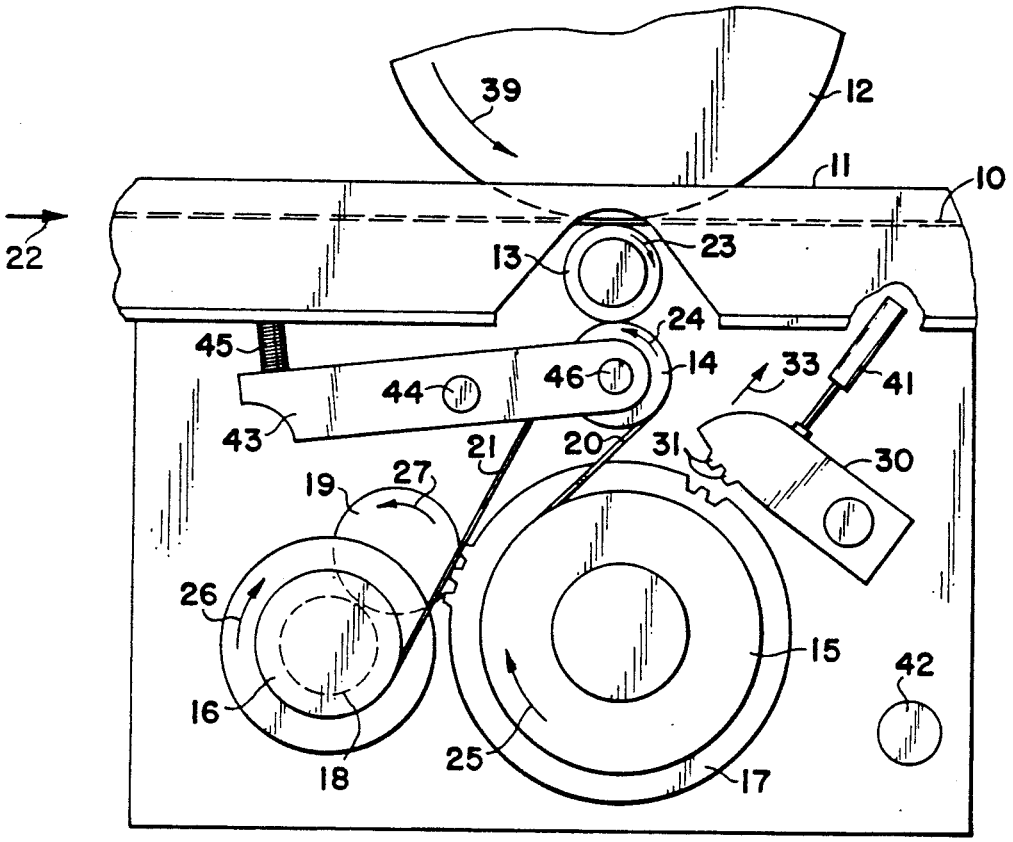
FIG. 1 shows a side elevational view of a portion of an integrated machine for handling cutting tape and for applying a strip of adhesive by the device of this invention.
Figure 2:
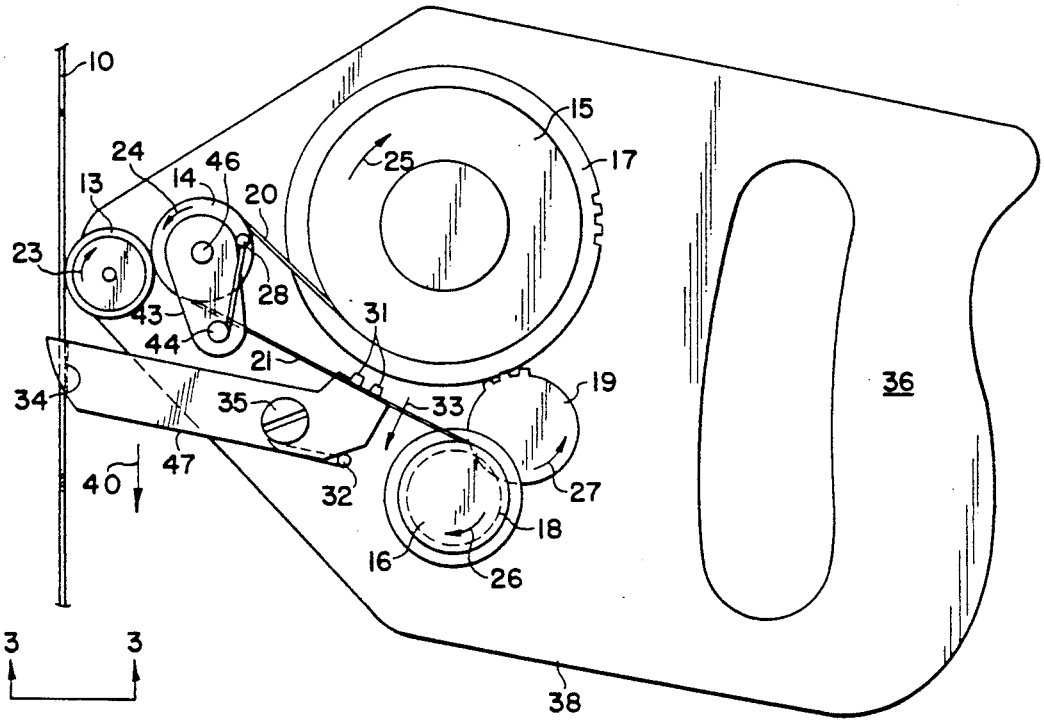
FIG. 2 shows a top plan view of a hand held adhesive applicator according to this invention.

In FIG. 1 there is shown how this invention can be incorporated into an integrated cutting tape handling apparatus, such as disclosed in my copending patent application Ser. No. 07/494,418 filed Mar. 16, 1990. In FIG. 2 of that patent application there is a schematic elevational view of an apparatus for conducting a length of cutting tape through a guide, cutting it to the paper length, applying a strip of adhesive to a forward portion of the tape, delivering it to a feeder, and then, at a selected time, projecting it outward to an empty windup roller to begin winding a web of paper as the tape cuts through a traveling web. FIG. 1 of this application shows how the device of this invention is incorporated into that integrated machine.

Cutting tape 10 moves in the direction of arrow 22 through guide channel 11. When it is appropriate to place a strip of adhesive on the bottom of cutting tape 10, supply wheel 15 turns in the direction of arrow 25 to feed a composite tape 20 to small press roller 14. Composite tape 20 is a layer of double-sided pressure-sensitive adhesive stuck onto a layer of release liner which readily pulls away from the adhesive when the adhesive contacts a surface to which it has some affinity. In this instance the composite tape 20 passes around press roller 14 with the double-sided pressure-sensitive adhesive strip sticking to the transfer roller turning in the direction of arrow 23 and the release liner 21 directed to windup roller 16 turning in the direction of arrow 26. Transfer roller turns in the same direction as tape 10 as the two approach each other at a tangent. At the same time large pressure roller 12 presses downwardly against the upper surface of tape 10 as roller 12 turns in the direction of arrow 39. Under the pressure of roller 12 and roller 13 the double-sided pressure-sensitive adhesive strip attaches itself to the underside of tape 10 because its affinity to the twisted paper fiber in tape 10 is considerably greater than its affinity for silicone rubber covering transfer roller 13. It will be appreciated that transfer roller 13 should be somewhat elastic so as to provide an even pressure pushing against composite tape 20 on small pressure roller 14 on the one side and against tape 10 on the other side. Preferably, small pressure roller 14 is biased against transfer roller 13 by means of spring 45 acting on lever 43 pivoted at pin 44 and connected to shaft 46 of small pressure roller 14. The material of transfer roller 13 must also be slightly tacky to the strip of pressure-sensitive adhesive so as to pull it away from release tape 21 but not so tacky that it will not easily release the adhesive strip to cutting tape 10. Silicone rubber is a preferred material, but there are other rubbery materials that are also operable, e.g., neoprene, nylon, butadiene rubber, polyolefin elastomers, etc.

In order to drive the device of this invention there is shown a gear train with gears on wheel 17 of supply roller 15, wheel 18 of windup roller 16, and an idler gear 19 engaged with both of gear wheels 17 and 18. It will be appreciated that idler gear 19 is employed in order to make rollers 15 and 16 turn in the direction of arrows 25 and 26 to remove tape 20 from roller 15 and to wind up liner 21 on roller 16. Idler gear 19 can be eliminated by rewinding liner 21 in the opposite direction on roller 16. A motor or other driving force may be attached to any of roller 15, roller 16, or gear 19 to provide power for the entire device. Friction between tape 20 and roller 14, and between rollers 14 and 13 causes these components to turn.

Timing devices well known in the art can be employed to start and stop the driving of this device when a desired length of adhesive strip has been applied. In the embodiment of FIG. 1 pressure roller 12 lifts slightly away from roller 13 after a selected length of tape 10 has passed, and, at the same time, positive stop arm 30, which is powered by a pneumatic cylinder 41, pushes teeth 31 into the teeth on gear wheel 17 causing roller 15 to stop turning while tape 10 continues to move. When roller 15 stops, rollers 13 and 14 also stop rupturing the strip of adhesive at 12 o'clock on transfer roller 13. When it is time to begin applying a new adhesive strip, cylinder 41 is activated to cause arm 30 to be withdrawn, and at the same time pressure roller 12 moves downward onto tape 10, applying the adhesive strip to tape 10. There is also shown button 42 which is pushed to cause cylinder 41 to pull arm 30 away from gear wheel 17 when it is necessary to insert a new roll of composite tape 20 on roller 15 and to thread the tape around rollers 13, 14 and 16.

Figure 3:
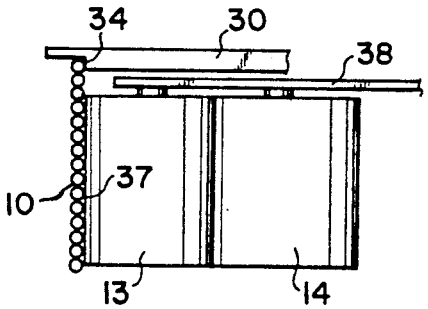
FIG. 3 is a partial side elevational view taken at 3—3 of FIG. 2.

In FIGS. 2-3 there is shown a device to be held in an operator's hand to be used to apply a strip of adhesive to a surface, e.g., a paper cutting tape 10. The same components as those described above with respect to FIG. 1 are employed in FIG. 2 with the same function and same operations. Supply roller 15 rotates in the direction of arrow 25 to deliver composite tape 20 to press roller 14, which in turn, transfers the adhesive strip from composite tape 20 to transfer roller 13 and returns the release tape from composite tape 20 to windup roller 16. Gear wheels 17 (on roller 15) and 18 (on roller 16) are engaged with idler gear wheel 19 to provide the appropriate movement to these components in the directions of arrows 25, 26, and 27, respectively. These components are all mounted on an appropriate frame 38 which may be as simple as a plate of aluminum with a suitable handle 36 in the nature of a saw grip or a pistol grip. The device is operated by pressing frame 38 and roller 13 toward the surface to which the adhesive strip is to be applied. In this illustration the surface is cutting tape 10, and so roller 13 is pressed against tape 10 and moved in the direction of arrow 40 while maintaining roller 13 pressed against tape 10. This causes roller 13 to turn in the direction of arrow 23. Friction causes press roller 14 to move in the direction of arrow 24 and also causes composite tape 20 to be unwound from supply roller 15 causing it to turn in the direction of roller 25. There also is a lever means 43 which is mounted on shaft 46 of roller 14 and is biased by spring 28 around pivot pin 44 to apply pressure against transfer roller 13. Gear wheels 17, 18 and 19 cause windup roller 16 to turn in the direction of arrow 26. If gear teeth on wheels 17, 18 and 19 are identical the linear movement of tape 20 will be exactly the same as the linear movement of liner 21, thus, synchronizing the unwinding of composite tape with the windup of release tape.

In this embodiment, there is an added feature of a stop/guide arm 47 which has one or more gear tooth projections 31 at the end of arm 47 adjacent gear wheel 17, and has a guiding ledge 34 adjacent the other end (distal end) of arm 47. Arm 47 is pivoted in its central portion at pin 35 and is fitted with a spring 32 to bias gear teeth 31 toward gear wheel 17. Gear teeth 31 are shaped so as to mesh with the teeth in gear wheel 17, or, alternatively, the projection 31 is shaped so as to wedge itself into the gears of wheel 17 and prevent it from turning. As may be appreciated, when projections 31 are moved to make contact with gear wheel 17, roller 15 cannot turn, and this effecitvely stops the turning of rollers 13 and 14, idler gear 19, and roller 18. This prevents the unwinding of supply roll 15 until the operator wants to apply a strip of adhesive to a surface such as tape 10. When that time occurs the device is placed so that guiding ledge 34 is positioned along the edge of tape 10 (see FIG. 3) or along the edge of any other surface to which a strip of adhesive is to be applied, and pressure is applied pushing roller 13 against the tape 10. This causes arm 47 to pivot, moving teeth 31 away from wheel 17 in the direction of arrow 33 and freeing supply roller 15 and all other rollers and gear wheels to turn. When the adhesive strip has been applied, the operator lifts roller 13 away from tape 10 or the substitute surface, causing arm 47 to pivot back to the position where teeth 31 engage gear wheel 17 and stop the movement of rollers 13-16 and gear 19. The fragility of the adhesive strip is such that the strip ruptures near the contact line between tape 10 and transfer roller 13. No positive cutting action is necessary if the adhesive strip is sufficiently thin, i.e., on the order of 0.001 to 0.005 inch.

It is also to be noted that the hand-held embodiment of FIG. 2 can be used to apply double-sided adhesive tape to any surface by merely adding a knife or scissors to cut the double-sided tape when the desired length has been applied. In this instance, of course, there is no need for roller 16 to wind up liner 21.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A device for applying a strip of double-sided pressure sensitive adhesive tape to a surface, said device comprising a supporting frame, a rotatable supply roll of composite tape consisting of a layer of double-sided adhesive tape adhered to a strippable backing liner; a rotatable transfer roller having a surface with a poor affinity for said adhesive tape; a rotatable rubbery pressure roller positioned to receive said composite tape from said supply roll and press a side with the double-sided adhesive tape against said transfer roller; a rotatable windup roller to receive said backing liner; means for coordinating the rotation of said supply roll with the rotation of said windup roller; and stop means for selectively permitting or preventing the rotation of said supply roll.

2. The device of claim 1 wherein said frame includes a handle permitting an operator of the device to press said transfer roller against a surface while moving device in a predetermined direction which rotates said transfer roller generally in a direction opposite to said predetermined direction and along a surface to apply a strip of said double-sided pressure-sensitive adhesive thereto.

3. The device of claim 2 wherein said handle has a hand grip portion.

4. The device of claim 1 wherein said surface of said transfer roller is silicone rubber.

5. The device of claim 1 wherein said stop means includes a gear wheel affixed to said supply roll, a pivotable spring-biased arm attached to said frame, and a gear tooth on said arm which when pivoted will engage said tooth with gears on aid wheel and thereby prevent it from rotating.

6. The device of claim 5 wherein said pivotable arm is spring biased to urge said tooth into engagement with said gear wheel.

7. The device of claim 6 wherein said tooth is at one end of said arm, a guiding ledge located at another end of said arm for guiding said transfer roller to apply to said strip of pressure-sensitive tape parallel to an edge of a surface.

8. A device for applying a strip of double-sided pressure-sensitive tape to a surface; said device comprising a supporting frame to which are attached four rotatable rollers for handling and applying said tape, said rollers including a first roller for containing a supply of composite tape including a nonadhesive backing liner carrying on one side thereof a strip of double-sided pressure-sensitive adhesive tape, a second roller for receiving said composite tape from said first roller and pressing said adhesive tape strip against a third roller, said third roller having a poor affinity for said adhesive tape and being adapted to receive said pressure-sensitive adhesive strip disconnected from said backing liner and pressing said adhesive strip onto said surface, and a fourth roller to receive and windup said backing liner separated from said adhesive tape at the contact between said second and third rollers, said first and said fourth rollers being operatively joined by gear means to rotate simultaneously, and correspondingly; and a selective locking and unlocking means to prevent and permit, respectively, the rotation of said first roller.

9. The device of claim 8 wherein said locking and unlocking means includes a pivotable arm with gear teeth engageable with said gear means to prevent rotation of said first roller.

10. The device of claim 8 wherein said second roller is movable with respect to said frame and is spring biased to press against said third roller.

11. The device of claim 8 in combination with an apparatus for feeding a paper cutting tape to a travelling web of paper wherein said apparatus includes a station for applying a strip of adhesive to the bottom of the forward portion of said cutting tape in which a press roll presses said cutting tape downward against said third roller as said cutting tape moves horizontally.

12. The device of claim 9 which additionally includes a pressurized fluid cylinder means to selectively move said arm into or out of engagement with said gear means.

13. A device for applying a strip of double-sided pressure sensitive adhesive tape to a surface, said device comprising a supporting frame, supply spool means connected to said frame to removably attach to said frame, a rotatable supply roll of composite tape consisting of a layer of double-sided adhesive tape adhered to a strippable backing liner, a rotatable transfer roller attached to said frame and having a poor affinity for adhesive tape, a rotatable pressure roller attached to said frame and positioned to receive a composite tape from a supply roll and press a side with a layer of double-sided adhesive tape against said rotatable transfer roller, a rotatable windup spool means attached to said frame to receive a backing tape of a composite tape, means for coordinating the rotation of said supply spool means with the rotation of said windup spool means and stop means for selectively permitting or preventing the rotation of said supply spool means.

14. The device of claim 13 wherein said frame includes a handle for grasping by an operator for pressing said transfer roller against a surface while moving said device in a predetermined direction which rotates said transfer roller generally in a direction opposite to said predetermined direction and along a surface to apply a strip of a layer of double-sided pressure-sensitive adhesive thereto.

15. The device of claim 13 wherein said transfer roller has a silicone rubber surface.

16. The device of claim 13 wherein said stop means includes a gear wheel affixed to said supply spool means, a pivotal arm attached to said frame, and at least one gear tooth on said arm which when pivoted toward said wheel will cause said at least one tooth to engage with gears on said wheel and thereby prevent it from rotating.

17. Tee device of claim 16 wherein said arm is elongated and has opposite end portions, one end portion of said arm carrying said at least one tooth, said arm having a guiding ledge on another said portion for guiding said transfer roller to apply a strip of a layer of double-sided pressure-sensitive tape parallel to an edge of a surface engaged by said guiding ledge.

18. The device of claim 13 further comprising a pivotal arm mounted to said frame, said arm movably mounting said pressure roller with respect to said frame, and spring biasing means engaged between said arm and said frame to press said pressure roller against said transfer roller with a composite tape sandwiched therebetween.

19. The device of claim 13 further comprising a press roll for pressing a paper cutting tape which is adapted to cut a traveling web of paper against said transfer roller as a paper cutting tape moves therebetween whereby a layer of double-sided pressure sensitive tape is transferred onto a paper cutting tape.

20. The device of claim 8 further comprising a pivotal arm mounted to said frame, said arm movably mounting said second roller with respect to said frame, and spring biasing means engaged between said arm and said frame to press said second roller against said third roller with said composite tape sandwiched therebetween.

* * * * *